US008613140B2

(12) United States Patent
Chen

(10) Patent No.: US 8,613,140 B2
(45) Date of Patent: Dec. 24, 2013

(54) HEAT SINK AND METHOD FOR MANUFACTURING THE SAME

(76) Inventor: Shyh-Ming Chen, Taipei County (TW)

( * ) Notice: Subject to any disclaimer, the term of this patent is extended or adjusted under 35 U.S.C. 154(b) by 713 days.

(21) Appl. No.: 12/821,157

(22) Filed: Jun. 23, 2010

(65) Prior Publication Data

US 2011/0315366 A1 Dec. 29, 2011

(51) Int. Cl.
*B21D 53/02* (2006.01)
*H05K 7/20* (2006.01)

(52) U.S. Cl.
USPC ..... 29/890.03; 165/78; 165/80.3; 165/185; 361/704

(58) Field of Classification Search
USPC ..... 165/78; 29/890.03
See application file for complete search history.

(56) References Cited

U.S. PATENT DOCUMENTS

| | | | | |
|---|---|---|---|---|
| 2007/0029068 | A1* | 2/2007 | Cheng et al. | 165/80.3 |
| 2007/0102147 | A1* | 5/2007 | Chang | 165/185 |
| 2008/0073070 | A1* | 3/2008 | Kuo | 165/185 |
| 2009/0025906 | A1* | 1/2009 | Huang | 165/80.3 |
| 2010/0263850 | A1* | 10/2010 | Huang | 165/185 |

* cited by examiner

*Primary Examiner* — Leonard R Leo

(57) ABSTRACT

A heat sink composed of a fin set and a seat and a method for manufacturing the same are disclosed. One side of the fin set is provided with a plurality of rail rods whose cross sections are of a hook shape. One side of the seat is formed with a plurality of slots corresponding to the rail rods. Thus the fin set and the seat can be assembled by engagement of the rail rods and slots. A press mold is employed to press the rail rods and the slots, thus the rail rods and slots are deformed to make the fin set and seat tightly engage with each other.

12 Claims, 11 Drawing Sheets

HEAT SINK AND METHOD FOR MANUFACTURING THE SAME

BACKGROUND OF THE INVENTION

1. Technical Field

The invention generally relates to heat sinks, particularly to assembling of fins and a seat.

2. Related Art

An ordinary aluminum heat sink is composed of fins and a seat, which are separately formed and then assembled together. And great thermal conductivity must be formed between the fins and seat. FIGS. 1A and 1B show a typical assembling method of fins and seat. One side of the seat 1 is cut by a scraping cutter to form a plurality of parallel deep slots 11 and shallow slots 12, which are alternately arranged. The fins 2 are separately embedded in the deep slots 11. Then a press mold 3 like a knife is inserted into a gap between two fins 2 to press the shallow slots 12. The shallow slots 12 are deformed outwards to tightly nip the fins 2. Thus the fins and seat can be tightly assembled together.

However, there is a serious drawback in the above method. Both the scraper cutter for cutting the slots 11, 12 and the press mold 3 for pressing the shallow slots 12 must be very sharp. Their knives tend to be blunt, cracked or misshapen, so they must be often maintained and replaced. Not only will the production cost increase but also the replacement operation must interrupt the production process. Therefore, it is very uneconomical to the manufactures.

SUMMARY OF THE INVENTION

An object of the invention is to reduce production cost and to shorten tact time by not employing scraper cutter and knife-shaped press mold.

To accomplish the above object, the invention provides a heat sink and a method for manufacturing the same. The heat sink is composed of a fin set and a seat. One side of the fin set is provided with a plurality of rail rods whose cross sections are of a hook shape. One side of the seat is formed with a plurality of slots corresponding to the rail rods. Thus the fin set and the seat can be assembled by engagement of the rail rods and slots. A press mold is employed to press the rail rods and the slots, thus the rail rods and slots are deformed to make the fin set and seat tightly engage with each other.

DETAILED DESCRIPTION OF THE INVENTION

Figure 1B:
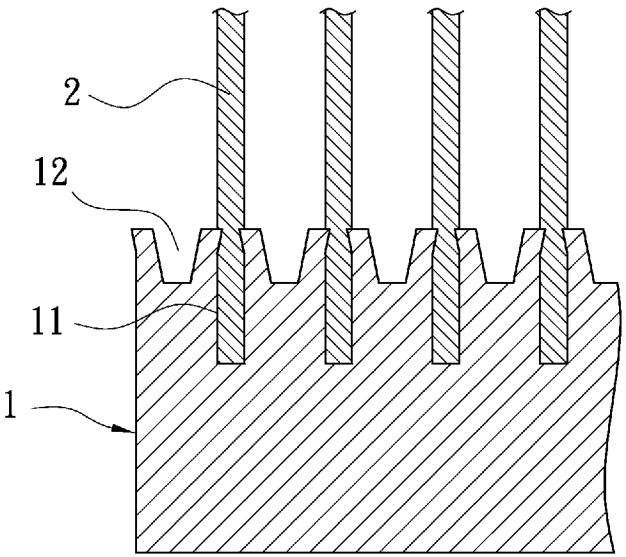
FIG. 1B (Prior Art)
FIGS. 1A and 1B show a conventional method for manufacturing a heat sink.
Figure 1A:
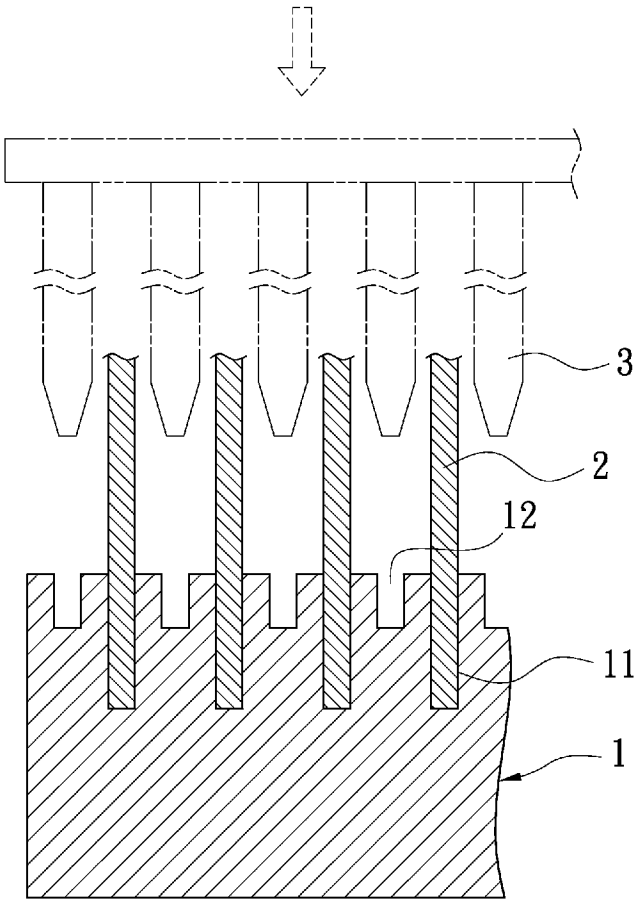
FIG. 1A (Prior Art)
Figure 2:
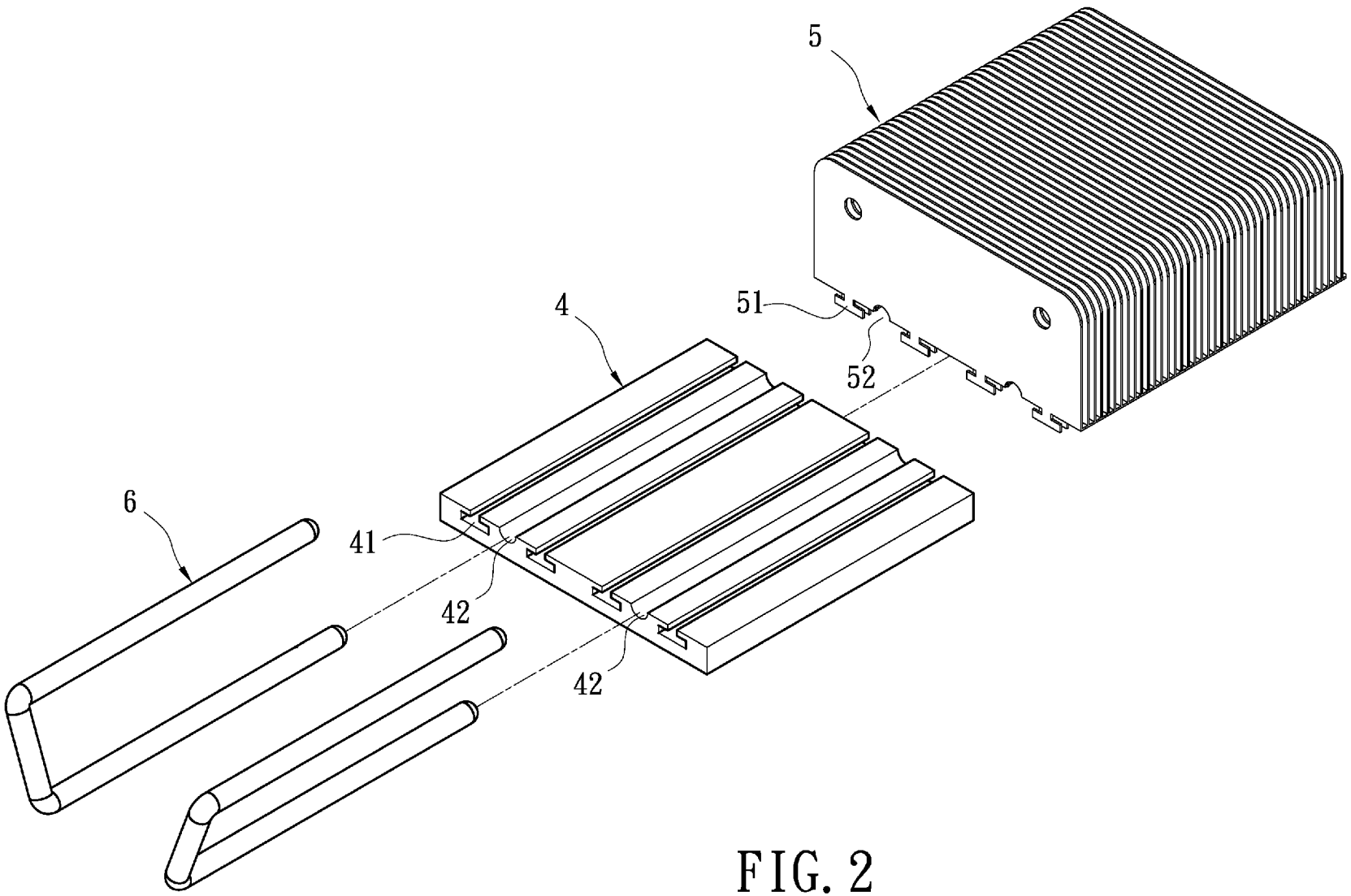
FIG. 2 is an exploded perspective view of the first embodiment of the invention.

FIG. 2 shows an exploded view of the first embodiment of the invention. The heat sink of the invention is composed of a seat 4 and a fin set 5. If needed, one or more heat pipes 6 additionally disposed to connect the seat 4 to the fin set 5. The bottom of the fin set 5 to be connected with the seat 4 is provided with a plurality of parallel rail rods 51 whose cross sections are of a hook shape. In the shown embodiment, the cross section of the rail rod 51 is of an inverted-T shape. The fin set 5 is composed of a plurality of fins stacking up with each other. One side of the seat 4 is formed with a plurality of slots 41 corresponding to the rail rods 51. The seat 4 and fin set 5 can be assembled together by embedding the rail rods 51 into the slots 41. Additionally, the seat 4 and fin set 5 may be separately provided with semicircular troughs 42, 52. A pair of semicircular troughs 42, 52 may form a circular trough for accommodating a heat pipe 6.

Figure 3:
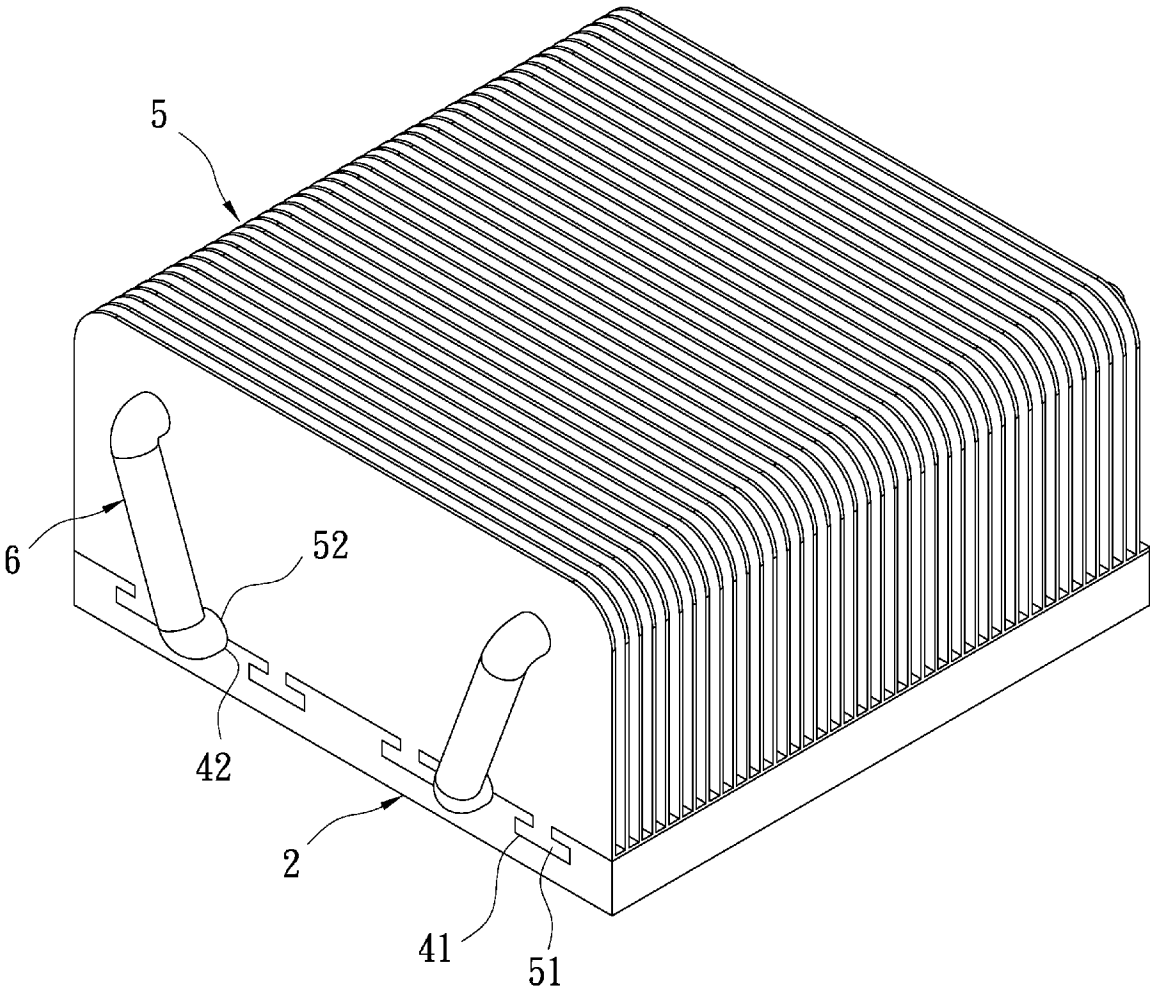
FIG. 3 is an assembled perspective view of the first embodiment of the invention.
Figure 4:
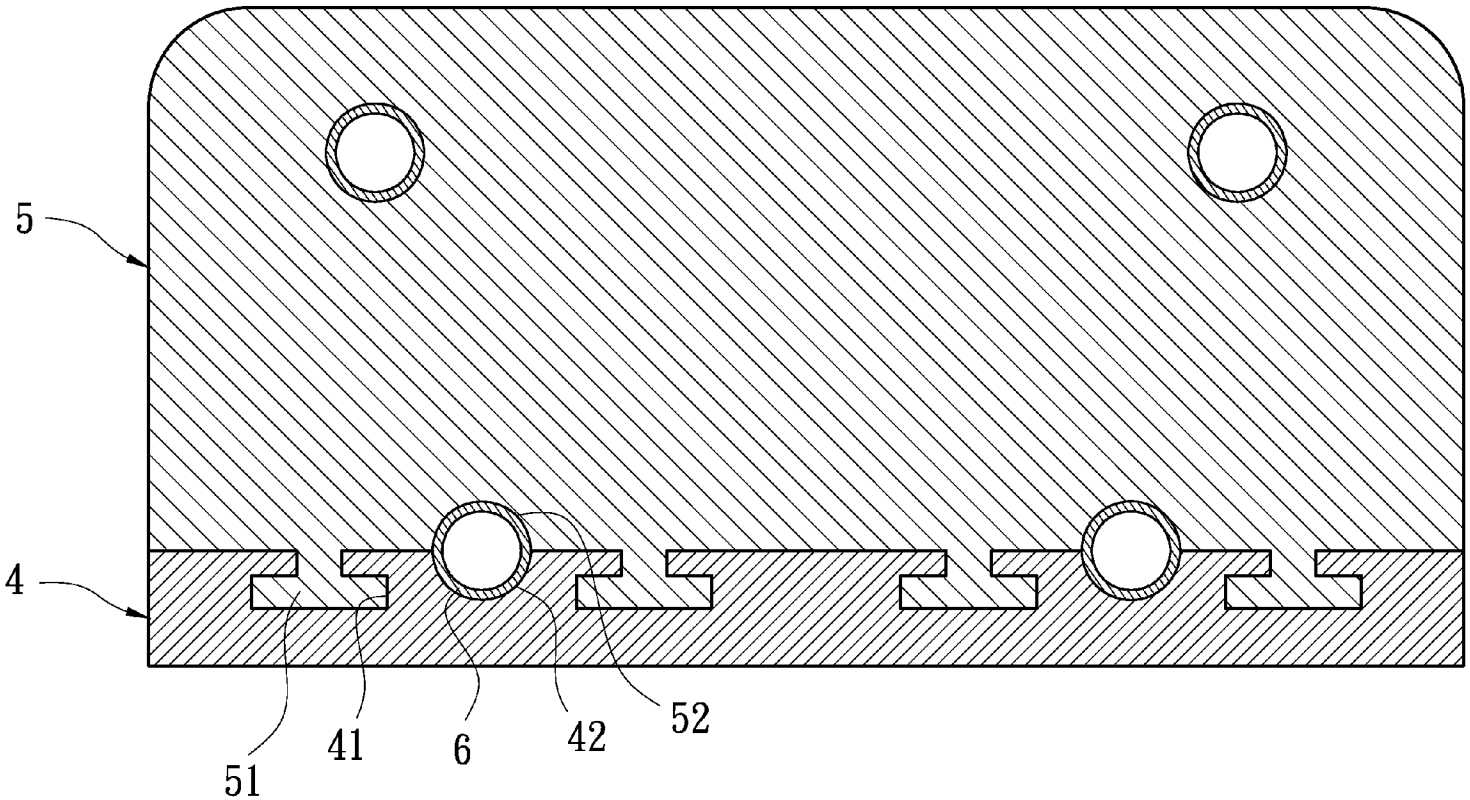
FIG. 4 is a cross sectional view of the first embodiment of the invention.
Figure 5B:
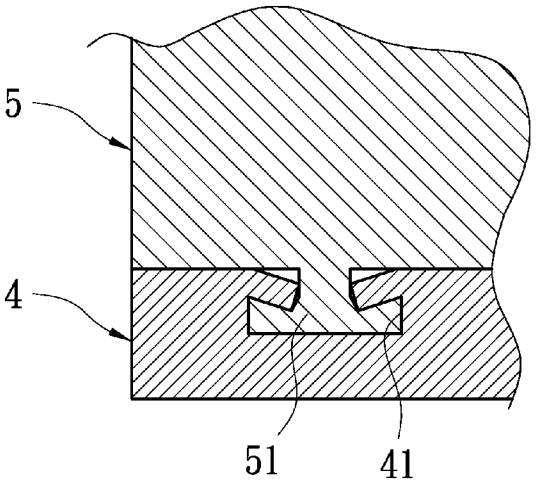
FIGS. 5A and 5B show a comparison of the first embodiment before and after pressing.
Figure 5A:
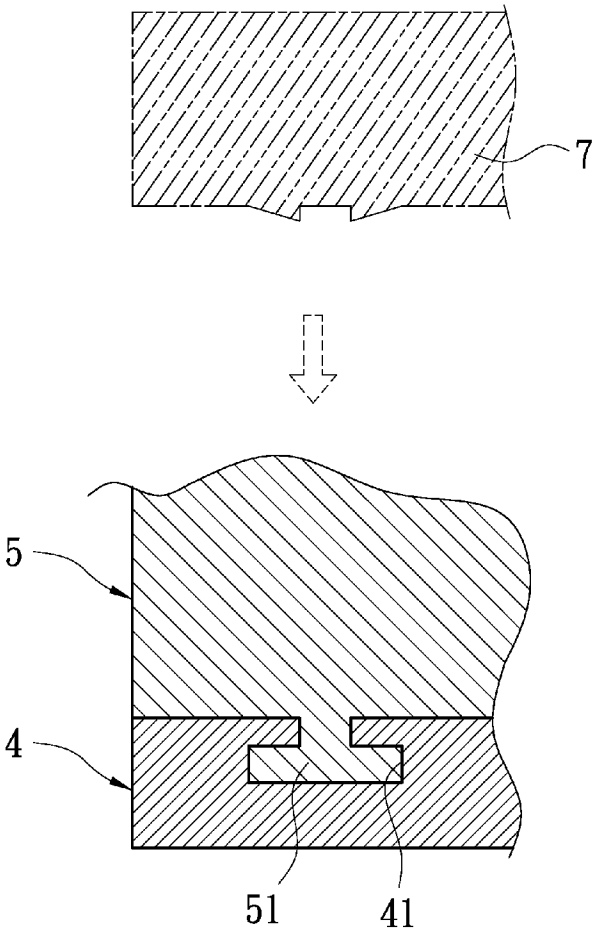
Figure 6:
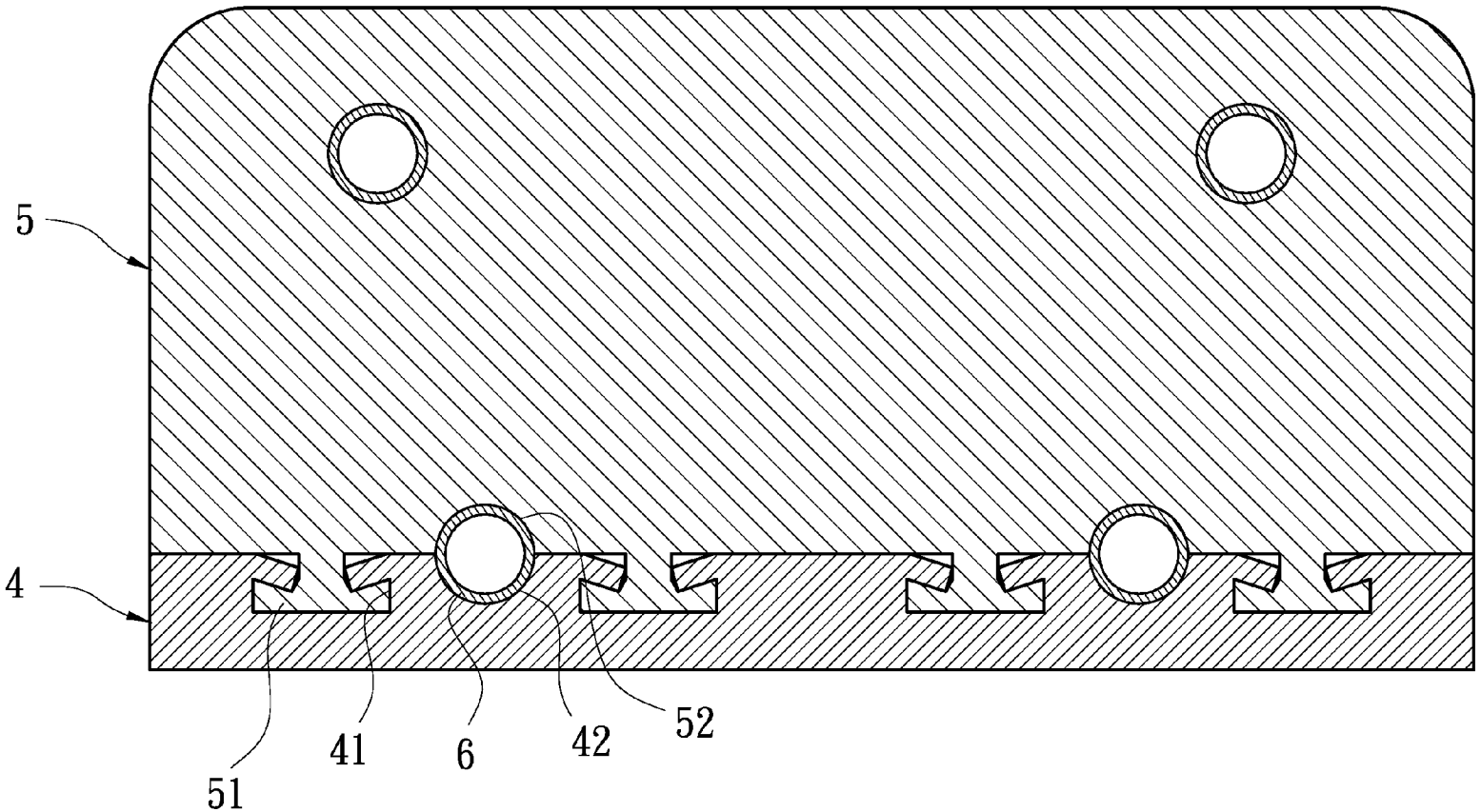
FIG. 6 is a cross sectional view of the first embodiment after pressing.

FIGS. 3 and 4 are an assembled perspective view and cross sectional view of the first embodiment of the invention, respectively. By engaging of the inverted-T-shaped rail rods 51 and slots 41, the seat 4 and fin set 5 has been connected but not tightly assembled yet. Next, as can be seen in FIG. 5A, a press mold 7 is embedded into a gap between two adjacent fins of the fin set 5 to press the slots 41. The press mold 7 has a specific outline for pressing two opposite ends of the inverted-T-shaped slots 41. The slots 41 are thus deformed by this pressing, and the rail rods 51 of the fin set 5 are also deformed. As a result, the seat 4 and fin set 5 are tightly assembled together as shown in FIGS. 5B and 6.

Figure 7B:
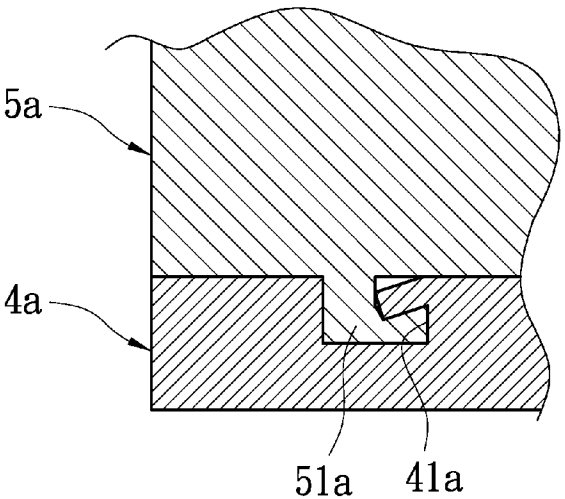
FIGS. 7A and 7B show a comparison of the second embodiment before and after pressing.
Figure 7A:
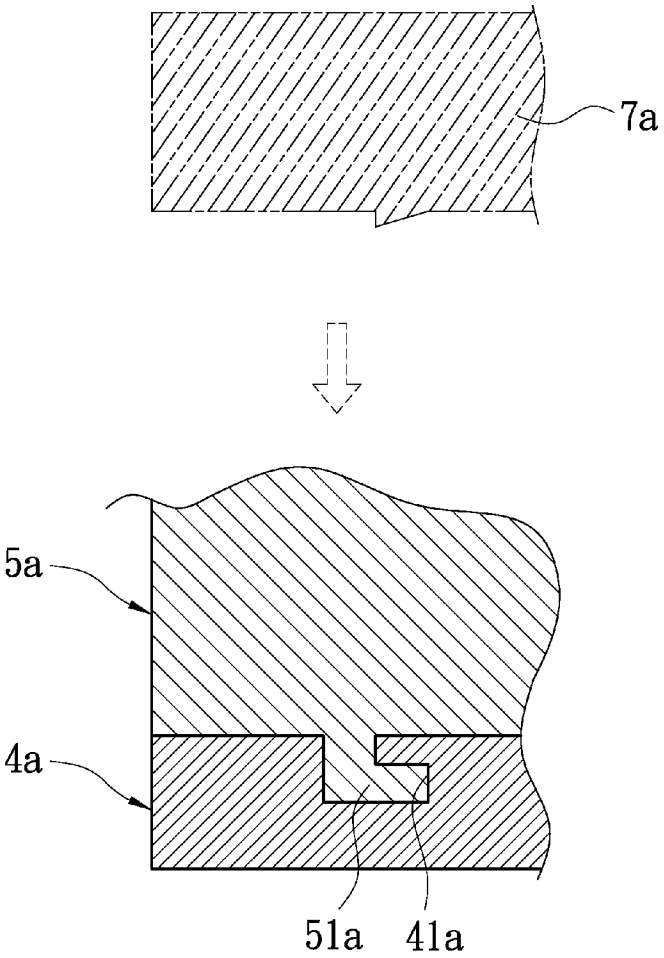
Figure 8B:
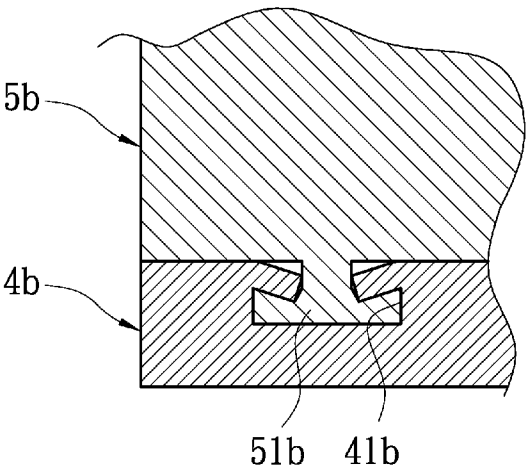
FIGS. 8A and 8B show a comparison of the third embodiment before and after pressing.
Figure 8A:
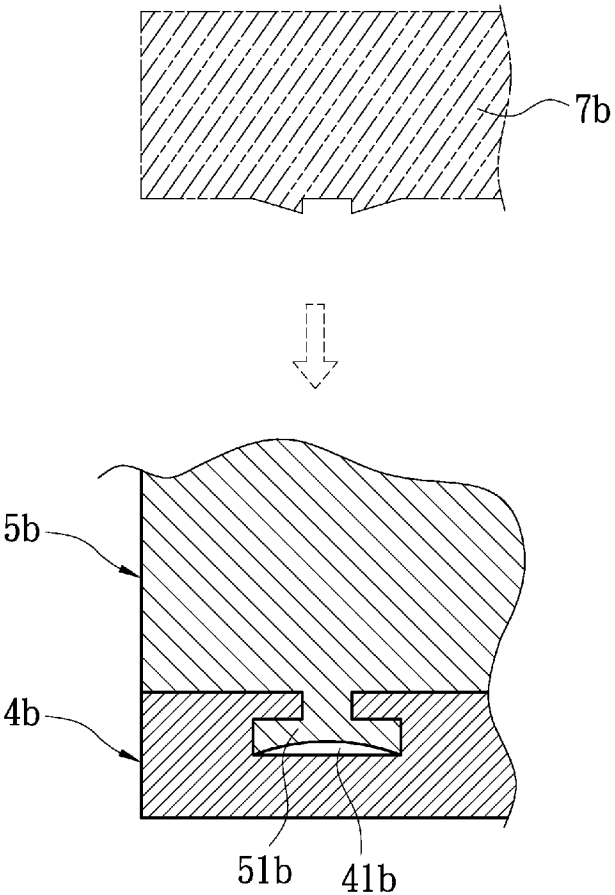
Figure 9B:
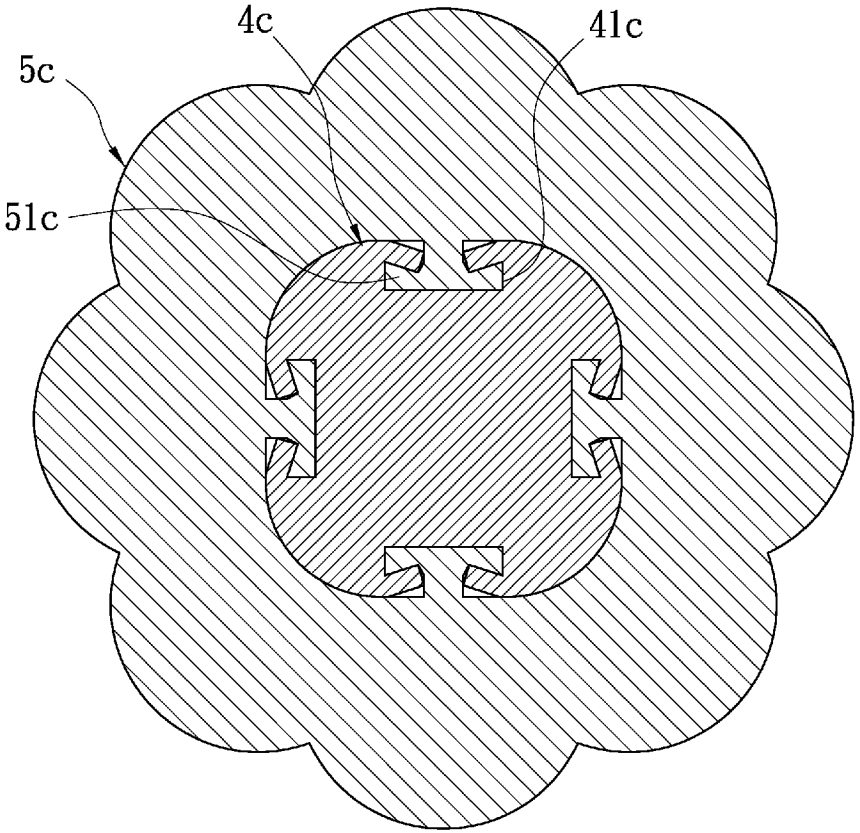
FIGS. 9A and 9B show a comparison of the fourth embodiment before and after pressing.
Figure 9A:
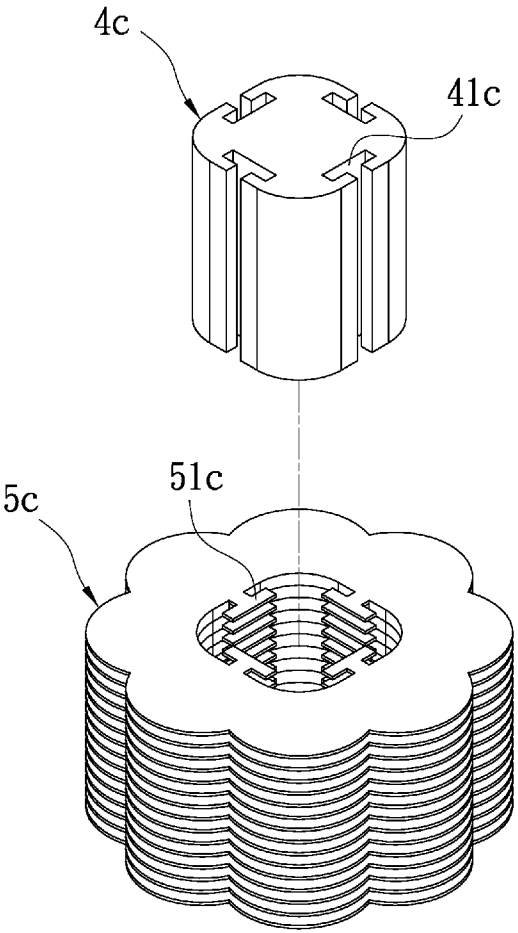
Figure 10B:
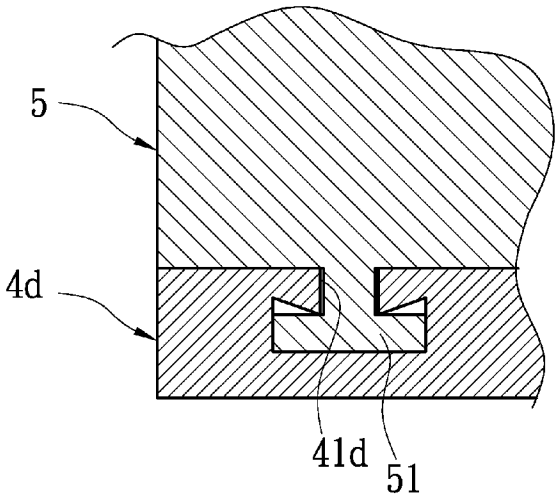
FIGS. 10A and 10B show a comparison of the fifth embodiment before and after pressing.
Figure 10A:
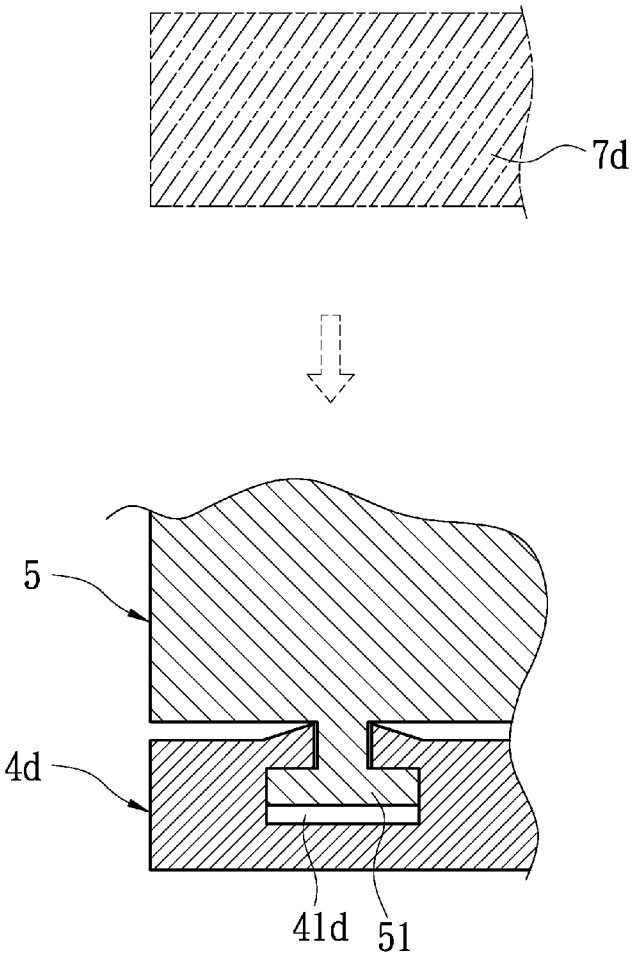
Figure 11:
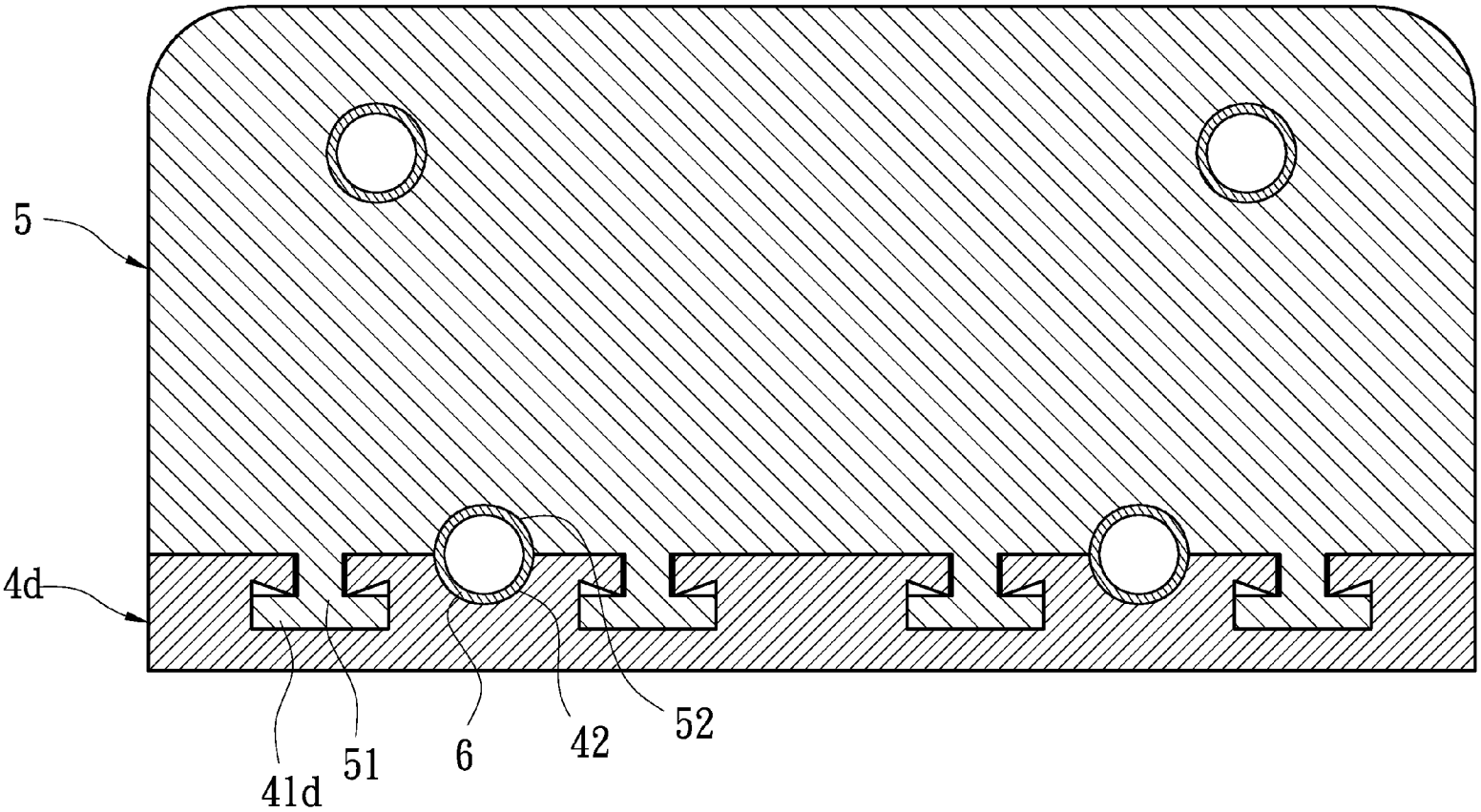
FIG. 11 is a cross sectional view of the fifth embodiment after pressing.

The shape of the rail rod 51 is not limit to the inverted-T shape as abovementioned. Any other shapes which can perform a hooking effect are available. As shown in FIGS. 7A and 7B, the rail rods 51*a* have a cross section of an L shape. Of course, shape of the press mold 7*a* must be modified correspondingly, so that it can press a distal end of the L-shaped slots 41*a*. Thus the slots 41*a* are deformed to make the fin set 5*a* and seat 4*a* tightly assembled together. FIGS. 8A and 8B show an inverted-T-shaped rail rod 51*b* with an indent on the center of the horizontal bar. Also, shape of the press mold 7*b* must be modified correspondingly, so that it can press the two opposite ends of the inverted-T-shaped slots 41*b*. Thus the slots 41*b* are deformed to make the fin set 5*b* and seat 4*b* tightly assembled together. FIGS. 9A and 9B show a hollow fin set 5*c* and a cuboidal seat 4*c* penetrating the fin set 5*c*. Four sides of the cuboidal seat 4*c* are separately provided with four T-shaped slots 41*c* and four corresponding rail rods 51*c* are formed inside the fin set 5*c*. The slots 41*c* are pressed by a press mold to be deformed. Thus the fin set 5*c* and seat 4*c* are tightly assembled together. FIGS. 10A and 10B show a fin set 5 with an inverted-T-shaped rail rods 51, which is the same as the embodiment shown in FIG. 2. And the seat 4*d* is correspondingly formed with inverted-T-shaped slots 41*d*. But the width of the horizontal bar of the slot 41*d* is larger than that of the rail rod 51 to form a room. And the top of slot 41*d* protrudes slightly. When a press mold presses down, the protrudent portion is deformed inwards to push the rail rod 51 to move downwards and to fill the room. Thus the fin set 5 and seat 4*d* are tightly assembled together.

It will be appreciated by persons skilled in the art that the above embodiments have been described by way of example only and not in any limitative sense, and that various alterations and modifications are possible without departure from the scope of the invention as defined by the appended claims.

What is claimed is:

1. A heat sink comprising:

a fin set, being provided with a plurality of parallel rail rods on one side thereof, wherein a cross section of each of the rail rods is of a hook shape; and a seat, being formed with a plurality of slots corresponding to the rail rods;

wherein the rail rods are separately accommodated in the slots, and the seat and the fin set are tightly assembled together by deformation of the slots;

wherein the cross section of each of the rail rods is T-shaped and the slots are the same in shape;

wherein a width of a horizontal bar of each the slot is larger than that of each the rail rod to form a room and a top of each the slot protrudes.

2. The heat sink of claim 1, wherein the cross section of each of the rail rods is of an inverted-T-shape with an indent at a center of a horizontal bar thereof and the slots are inverted-T-shaped.

3. The heat sink of claim 1, wherein the seat is a cuboid and the fin set has a hollow for accommodating the seat.

4. The heat sink of claim 3, wherein sides of the seat are provided with a plurality of slots and the fin set is provided with corresponding rail rods.

5. The heat sink of claim 4, wherein the cross section of each of the rail rods is inverted-T-shaped and the slots are the same in shape.

6. The heat sink of claim 3, wherein the cross section of each of the rail rods is inverted-T-shaped and the slots are the same in shape.

7. A method for manufacturing a heat sink, comprising the steps of:

a) providing a fin set, wherein the fin set is provided with a plurality of parallel rail rods on one side thereof, and a cross section of each of the rail rods is of a hook shape; and b) providing a seat, wherein the seat set is formed with a plurality of slots corresponding to the rail rods;

c) embedding the rail rods into the slots; and d) pressing the slots to be deformed, so that the seat and the fin set are tightly assembled together;

wherein the cross section of each of the rail rods is T-shaped and the slots are the same in shape;

wherein a width of a horizontal bar of each the slot is larger than that of each the rail rod to form a room and a top of each the slot protrudes.

8. The method of claim 7, wherein the cross section of each of the rail rods is of an inverted-T-shape with an indent at a center of a horizontal bar thereof and the slots are inverted-T-shaped.

9. The method of claim 7, wherein the seat is a cuboid and the fin set has a hollow for accommodating the seat.

10. The method of claim 9, wherein sides of the seat are provided with a plurality of slots and the fin set is provided with corresponding rail rods.

11. The method of claim 10 wherein the cross section of each of the rail rods is inverted-T-shaped and the slots are the same in shape.

12. The method of claim 11, wherein the cross section of each of the rail rods is inverted-T-shaped and the slots are the same in shape.

* * * * *